United States Patent [19]

Berg

[11] 4,398,474

[45] Aug. 16, 1983

[54] INSULATING STRUCTURE FOR HIGH TEMPERATURE DEVICES

[75] Inventor: Charles A. Berg, Buckfield, Me.

[73] Assignee: Pyreflex Corporation, Buckfield, Me.

[21] Appl. No.: 340,786

[22] Filed: Jan. 18, 1982

Related U.S. Application Data

[60] Continuation-in-part of Ser. No. 248,836, Mar. 30, 1981, which is a division of Ser. No. 105,510, Dec. 20, 1979, Pat. No. 4,290,475, which is a continuation-in-part of Ser. No. 10,712, Feb. 9, 1979, Pat. No. 4,256,919.

[51] Int. Cl.[3] ..... F23M 5/00

[52] U.S. Cl. ..... 110/336; 52/407

[58] Field of Search ..... 110/336, 337; 52/404, 52/405, 407

[56] References Cited

U.S. PATENT DOCUMENTS

| | | | |
|---|---|---|---|
| 624,828 | 5/1889 | Lantzke . | |
| 683,060 | 9/1901 | New . | |
| 958,095 | 5/1910 | Coleman | 52/405 |
| 1,845,064 | 2/1932 | Waite et al. | 110/336 |
| 1,890,418 | 12/1932 | Schmidt | 52/407 |
| 3,151,712 | 10/1964 | Jackson | 189/34 |
| 3,412,518 | 11/1968 | Waite | 52/592 |
| 3,619,340 | 11/1971 | Jones | 161/127 |
| 3,785,914 | 1/1979 | King | 161/133 |
| 3,799,056 | 3/1974 | Colignon | 102/105 |
| 3,958,714 | 5/1976 | Barriere et al. | 220/10 |
| 4,082,414 | 1/1978 | Berg | 350/103 X |
| 4,086,737 | 5/1978 | Byrd | 52/227 |
| 4,113,904 | 9/1978 | Kiefer | 428/34 |
| 4,160,577 | 7/1979 | Berg | 350/292 X |
| 4,173,668 | 11/1979 | Hentzlet et al. | 428/34 |
| 4,192,646 | 3/1980 | Berg | 432/239 |
| 4,256,919 | 3/1981 | Berg | 13/23 |

FOREIGN PATENT DOCUMENTS

| | | | |
|---|---|---|---|
| 3024968 | 2/1982 | Fed. Rep. of Germany | 110/336 |
| 46-19430 | 5/1971 | Japan | 164/122 |
| 173174 | 11/1960 | Sweden | 249/199 |
| 487710 | 5/1976 | U.S.S.R. | 249/199 |

*Primary Examiner*—Edward G. Favors
*Attorney, Agent, or Firm*—Lahive & Cockfield

[57] ABSTRACT

Disclosed is a structure for insulating high temperature devices such as furnaces. The insulating structure comprises a shell enclosing a series of refractory, substantially parallel, spaced-apart sheets, one or more of which may be reflective. The insulating structure stores little heat, is compact, and is lighter than refractory brick.

35 Claims, 3 Drawing Figures

INSULATING STRUCTURE FOR HIGH TEMPERATURE DEVICES

REFERENCE TO RELATED APPLICATIONS

This application is a continuation-in-part of copending U.S. application Ser. No. 248,836, filed Mar. 30, 1981, entitled Ingot Casting, which is a divisional of U.S. application Ser. No. 105,510, filed Dec. 20, 1979, now U.S. Pat. No. 4,290,475, also entitled Ingot Casting, which was a continuation-in-part of U.S. application Ser. No. 10,712, filed Feb. 9, 1979, now U.S. Pat. No. 4,256,919, entitled Temperature Confining Devices and Method, the disclosures of which are incorporated herein by reference. U.S. application Ser. No. 340,059, entitled Enclosing Structure For Cast Ingots, filed even date herewith, discloses related subject matter, the disclosure of which is also incorporated herein by reference.

BACKGROUND OF THE INVENTION

This invention relates to the construction and operation of high temperature devices. More particularly, it relates to the insulation of furnaces where heat flow through the walls must be minimized.

Currently, most high temperature furnaces are insulated with either cast refractory material or with refractory brick consisting chiefly of alumina, silicon carbide, silicon oxide, or similar materials. While these and related materials are capable of withstanding high temperatures, they also have relatively high thermal conductivity. For example, at approximately 2000° F., the thermal conductivity of alumina brick is approximately 3 BTU/ft°F. hr. Brick of the same material in a foamed configuration has a thermal conductivity of approximately 0.25 BTU/ft°F. hr. (Volume 1 of *Industrial Furnace,* W. Trinks and M. H. Mawhinney, John Wiley (5th Edition 1961). This material has limited load bearing capability at high temperature. The thermal conductivity for air at the same temperature is approximately 0.04 BTU/ft°F. hr.

A principal use of refractory material in furances is to reduce the temperature to a point where effective insulating materials which have much lower thermal conductivities can be used. Such insulators typically cannot be used at a temperature in excess of about 1000° F. Furnace enclosures are thus frequently built of two layers: a refractory inner layer capable of withstanding very high temperature which in use holds a significant heat gradient, and an outer layer which is a good insulator.

The materials currently used for insulating high temperature devices also store a significant quantity of heat. For example, some industrial steel reheating furnaces may take as much as 300 hours to heat to operating temperature. In furnaces for the manufacture of solid state equipment, maintenance of a constant temperature with only a one degree variance or less is critical. Accordingly, much fuel is wasted to keep the high temperature devices near operating temperature even when the devices are not being used. Because of these operating constraints, many industrial furnaces are never deenergized even though they may be used in production forty hours per week or less. Repairs to large furnaces or their liners are also put off until the damage is so extensive that the cost of losing up to 600 hours of production is outweighed by the energy loss caused by the damage.

SUMMARY OF THE INVENTION

This invention provides a structure for retarding heat loss from high temperature devices. More particularly, the structure insulates high temperature devices such as industrial furnaces by returning a portion of the radiation emitted by the heat source of the furnace back thereto, thereby reducing the net heat loss. The insulating structure is more compact and stores less heat than conventional refractory materials so that the high temperature devices do not have to be kept near operating temperatures at all times.

Insulation constructed according to the teachings of the invention reduces the flux of thermal radiation by returning a portion of the thermal radiation back to its source. The insulation comprises a structure having a shell of a refractory material including a front face for placement proximate the heat source. The shell defines a hollow interior and contains a plurality of spaced-apart, light-weight refractory baffles which greatly inhibit radiant heat flow in a manner disclosed hereinafter. Convective heat transfer is suppressed by appropriate spacing of the baffles or by evacuation of the interior of the structure. The structure also preferably includes one or more reflective surfaces facing the front face but located behind a number of baffles sufficient to prevent thermal degradation of the surface. The structure may be protected from thermal shock by employing flexible sidewalls connecting the front face, baffles etc. or by constructing the sidewalls of a material which has substantially zero thermal expansion.

In one embodiment, the structure comprises a furnace muffle. In another embodiment, the structure comprises a refractory tile for use in constructing insulating layers in high temperature devices.

Accordingly, it is an object of the invention to provide improved insulation for high temperature devices. Another object of the invention is to provide insulation effective at high temperatures, generally above about 1000° F., and preferably above 1500° F. or even 2000° F., which have low thermal conductivity and low thermal inertia. Still another object is to provide an insulating and refractory structure characterized by structural strength and rigidity at operating temperatures and by resistance to damage by rapid heating and cooling. Another object is to provide a furnace useful for high temperature applications which is fuel efficient.

These and other objects and features of the invention will be apparent from the following detailed description and from the drawing.

DESCRIPTION

The invention is used in connection with high temperature devices which operate at temperatures greater than 1000° F., probably greater than 2000° F., and is useful in place of refractory materials such as refractory firebrick and its associated insulation. As disclosed herein, the invention utilizes a different principle of operation from currently available high temperature insulating materials.

Current refractory materials transfer heat primarily by conduction rather than by radiation or convection. Heat flux by conduction ($q_{cn}$) is equal to:

$$q_{cn}=k\Delta T/\Delta x \quad (1)$$

where k is the thermal conductivity, T is the temperature difference and x is the length of the conductive path. If a nine inch thick refractory brick having a thermal conductivity (k) equal to 3 BTU/°F. ft hr. is heated to 2300° F. on one side and radiates heat to the environment at 300° F. on the other, $q_{cn}=8{,}000$ BTU/hr.ft$^2$. If a similar sized foamed (insulating) firebrick having a thermal conductivity of 0.25 BTU/hr.ft°F. is used in place of the high temperature refractory brick, $q_{cn}=667$ BTU/hr.ft$^2$. These figures will be used for comparison to show the efficacy of the proposed insulating structure.

In the operating temperature range of industrial furnaces, thermal radiation dominates heat transfer between any two bodies not in intimate contact. This is because the flux of thermal radiation from a surface is proportional to the 4th power of the surface temperature whereas heat transfer by convection is proportional to the 1st power of the surface temperature. A radiant heat source at absolute temperature T having an emmissivity E radiating to the environment at temperature $T_o$ with an emissivity $E_o$ has a radiant flux ($q_r$) from each unit area of the surface of:

$$q_r=\frac{\sigma(T^4-T_o^4)}{\frac{1}{E}+\frac{1}{E_o}-1} \quad (2)$$

where $\sigma$ (sigma) equals $0.1713\times10^{-8}$ BTU/ft$^2$hr.°F. The rate of heat transfer by convection ($q_c$) from the same surface is given by the equation:

$$q_c=h(T-T_o) \quad (3)$$

If $E=E_o=1$ (i.e., both surfaces act as black bodies), $T=2760°$ R. (2300° F.) and $T_o=760°$ R. (300° F.), the radiant heat flux ($q_r$) equals 98,830 BTU/hr.ft$^2$. This is more than 148 times as great as the conductive heat transfer through the insulating firebrick in the example above and more than twelve times as great as the heat flux through the high temperature refractory brick.

Figure 1:
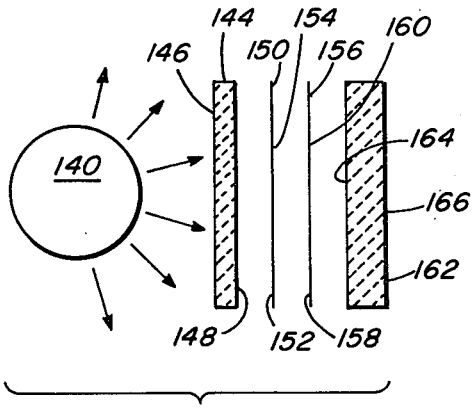
FIG. 1 is a schematic representation of a heat source surrounded by a series of parallel sheets useful in describing the operation of the invention.

The radiant heat flux by thermal radiation can be reduced by surrounding the radiant heat source with a series of substantially parallel, spaced-apart baffles. FIG. 1 schematically illustrates how a series of baffles can be placed to reduce the heat loss from a radiant heat source. Facing radiant heat source 140 is a structure comprising an innermost layer 144 having an inner surface 146 and an outer surface 148, two intermediate baffles 150 and 156 having inner surfaces 152 and 158 and outer surfaces 154 and 160, respectively, and outer layer 162, having an inner surface 164 and an outer surface 166. As explained in greater detail hereinafter, the number of layers surrounding the radiant heat source depends on the heat transfer characteristics one seeks. The four layers depicted in FIG. 1 are purely illustrative.

If radiant heat source 140 and the environment have emissivities $E_s=E_o=1$ (i.e., they act as black bodies), radiant heat source 140 is at a temperature $T_s$ and the environment is at a temperature $T_o$, and if radiant heat source 140 radiated directly to the environment (no baffles were present), then the radiant heat flux ($q_r$) would be expressed by the formula:

$$q_r=\sigma(T_s^4-T_o^4) \quad (4)$$

However, by enclosing radiant heat source 140 within a structure of the type illustrated, $q_r$ is reduced. If the emissivities of surfaces 146, 148, 152, 154, 158, 160, 164 and 166 are, respectively, $E_{1+}$, $E_{1-}$, $E_{2+}$, $E_{2-}$, $E_{3+}$, $E_{3-}$, $E_{4+}$, and $E_{4-}$, the radiant heat flux ($q_r$) to the environment with the structure in place would be expressed by the formula:

$$q_r=\frac{\sigma(T_s^4-T_o^4)}{\left(\frac{1}{E_{1+}}+\frac{1}{E_{1-}}+\frac{1}{E_{2+}}+\frac{1}{E_{2-}}+\frac{1}{E_{3+}}+\frac{1}{E_{3-}}+\frac{1}{E_{4+}}+\frac{1}{E_{4-}}-3\right)} \quad (5)$$

Generalizing, if a radiant heat source is surrounded by a structure consisting of n baffles or layers having emissivities $E_{n+}$ on surfaces toward the ingot and $E_{n-}$ on surfaces away from the ingot, the radiant heat flux ($q_r$) is given by the formula:

$$q_r=\frac{\sigma(T_s^4-T_o^4)}{\left(\sum_{n=1}^{n}\left(\frac{1}{E_{n+}}+\frac{1}{E_{n-}}\right)-(n-1)\right)} \quad (6)$$

If the emissivity E for each surface is approximately equal to 1, the radiant heat flux $q_r$ is reduced by a factor of $1/n+1$ by the structure. Therefore, to reduce, for example, the radiant heat flux by a factor of 10, 9 sheets are needed.

The foregoing discussion assumes that the emissivity E of each surface of the sheets is near 1.0, that is, acts as a black body. However, if one or more of the sheets has an emmissivity of appreciably less than 1, fewer sheets are required to achieve the same reduction in radiant heat flux. Referring again to FIG. 1, if, for example, the emissivities E of surfaces 158, 160 and 164 are 0.10 and the emissivities of the remaining surfaces are 1, the radiant heat flux $q_r$ would be reduced to 1/32 of the value that obtains with a radiant heat source radiating directly to the environment. If surfaces 148, 160 and 164 were not reflective ($E=1$), only a five-fold reduction in heat flux would be achieved.

It is evident from the foregoing that the use of reflective surfaces can reduce the number of baffles required to limit the radiant heat flux; this reduces the cost of construction and the fragility of the structure. However, there are several physical limitations which are important in making design choices. Specifically, most materials which have high reflectivity ($E<<1$) cannot withstand without degradation the temperatures to which they would be exposed. Thus it is useful to place the reflective surfaces away from the radiant heat source behind several protective baffles. The refractory protective baffles allow the use of reflective surfaces which would otherwise be degraded by the temperature of the radiant heat source. Thus one may use as many high emissivity refractory baffles as required to protect the reflective surface from destructive temperatures in use. Each reflective surface (having emissivity e) significantly improves the insulation properties of the structure. Specifically, use of a reflective surface alters the properties of the structure such that it acts as if there were n extra baffles surrounding the radiant heat source where:

$$n=(1-e)/e \quad (7)$$

It is possible to suppress convective heat transfer to trivial levels using baffles and reflectors by spacing the baffles (say) 0.01 inch apart. However, net heat transfer through the insulating structure includes a significant conduction of heat through the gas between the baffles. As previously noted, the radiant heat flux from one surface at 2300° F. to another at 300° F. is 98,830 BTU/ft$^2$ hr., approximately 148 times greater than the conductive heat flux through a nine inch insulating firebrick. If an insulating tile having 150 interior, refractory, non-reflective baffles, each 0.01 inches thick spaced 0.01 inches apart, surrounds a radiant heat source at 2300° F. and radiates heat to the environment at 300° F., the radiant heat flux ($q_r$) would be reduced by a factor of 151 to 655 BTU/ft$^2$ hr. Assuming that heat transfer by conduction through the baffles is negligible compared to the conduction through the air spaces:

$$q_{cn}=(k\Delta T)/(n\cdot\Delta x)=640 \text{ BTU/hr. ft}^2 \quad (8)$$

so the total flux of heat through the tile will be approximately 1294 BTU/hr.ft$^2$. If the front and back walls of the tile are 0.2 inches thick, the tile would be 3.41 inches thick or 37% the thickness of the comparable insulating firebrick. The insulating tile would weigh approximately 19% as much as the insulating firebrick (half the tile is hollow) and the heat transmission would be only twice that of the insulating firebrick.

The previous example illustrates the principles involved in designing an insulating tile to replace insulating firebrick. By increasing the number of baffles, the radiant heat flux across the tile can be reduced, thereby reducing the total heat flux. Another method of reducing the heat flux is to increase either or both the spacing between the baffles or the length of the conductive path so as to reduce the conductive heat flow. For example, if an insulating tile is constructed having 300 baffles each 0.01 inches thick, spaced 0.01 inches apart, and is subjected to a temperature of 2300° F. on one face and 300° F. on the other, $q_r$ is reduced to 328 BTU/hr.ft$^2$ and $q_{cn}$ equals 319 BTU/hr.ft$^2$ so the total heat flux is approximately 647 BTU/hr.ft$^2$ or 97% of the heat transmission of a nine inch thick insulating firebrick under the same conditions. The thickness of this tile is approximately 6.41 inches or 71% of the thickness of the firebrick while it weighs about 36% of the weight of the firebrick.

Thus far it has been assumed that all of the baffles are nonreflective (E=1). As previously noted, if an interior surface has an emissivity e appreciably less than 1, this is equivalent to adding (1−e)/e additional baffles. More generally, if one has r baffles with reflective surfaces, with each surface having an emissivity e, this is equivalent to adding ((2r)(1−e/e)) additional baffles. Therefore, if the surfaces of four interior baffles had emissivities of 0.034 (which is attainable at 1000° F. for infrared radiation), this would be equivalent to adding 226 additional baffles. Therefore, a structure having 74 non-reflective baffles plus 4 highly reflective interior baffles would have equivalent thermal radiation characteristics to a tile having 300 non-reflective baffles. If such a tile were constructed with spacing of 0.077 inches between the baffles, it could be approximately 7.8 inches thick and would reduce the heat transmission to approximately the same level as nine inches of insulating firebrick while weighing only eight to ten percent as much. If the enclosure were evacuated, the baffles could be 0.005 inches thick and spaced 0.005 inches apart. The tile thus could be 1.91 inches thick and still reduce the heat transmission to about 329 BTU/ft$^2$hr. when subjected to a temperature of 2300° F. on one face and 300° F. on the other, or approximately one-half the heat transmission of nine inches of insulating firebrick under the same conditions.

It should be noted that the reflective surfaces should be placed generally furthest from the radiant heat source so that the temperature to which they are exposed is low enough for the surfaces to survive without damage. Thus, non-reflective or marginally reflective baffles interposed between the reflective surface and the heat source serve to both confine the heat and to protect the reflective surface.

Spacings of 0.005–0.077 inches have been used as examples of the distance between adjacent baffles. This spacing will substantially eliminate convective heat transfer between adjacent plates. Convective heat transfer between vertical plates (an instability more easily set off than convective heat transfer between horizontal plates) is suppressed when the dimensionless Grashof number is less than $2\times10^3$. The Grashof number ($N_g$) is given by the expression:

$$N_g=x^3\beta g\Delta T/\nu^2$$

where x is the spacing between the surfaces, g is the acceleration of gravity, the thermal expansion of the gas ($\beta$) is approximately equal to 1/T (absolutes temperature) the kinimatic viscosity ($\nu$) is approximately 5 ft$^2$/hr. and $\Delta T$ between adjacent surfaces is approximately 10$^2$° F. Therefore, $N_g\sim600{,}000$ ($x^3$) and if $N_g$ is less than $2\times10^3$, $x^3$ is less than $3.3\times10^{-3}$ ft$^3$ or x is less than 1.8 inches. Thus, if the spacing between adjacent baffles is less than 1.8 inches, convection will be suppressed.

Because of convective and conductive effects, a design choice must be made with respect to the spacing of the baffles. So long as the spacing is selected so that convective effects are substantially eliminated, the widest possible spacing between baffles is desirable so as to use the full insulating effect of air to minimize conductive losses. However, it is also preferable to make the insulating tile as compact as possible by spacing the baffles relatively closely. One possible means for achieving both ends is evacuation of the tile. If the interior of the tile is at a subatmospheric pressure, heat transfer by convection is eliminated and heat transfer by conduction is minimized. Therefore, if the insulating tile is evacuated, closer spacing of baffles and a more compact tile is possible without getting the undesirable side effect of increasing conductive heat transfer. If the tile is evacuated, the sidewalls must be thicker thereby increasing the rate of conductive heat transfer through the sidewalls, and the cost of manufacture of the tile will increase.

Figure 2:
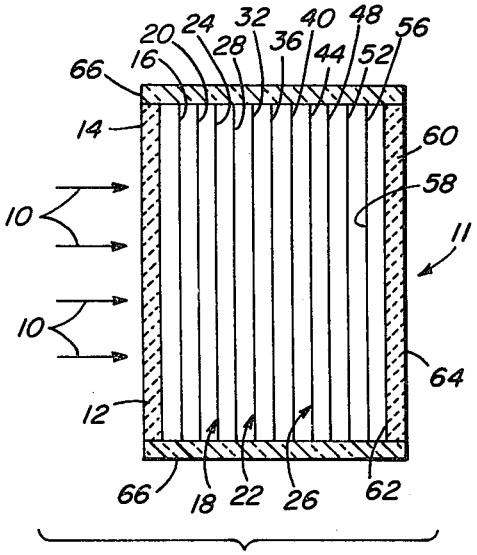
FIG. 2 is a schematic view in cross-section of an insulating tile constructed in accordance with the invention.

Referring to the drawing, FIG. 2 illustrates a cross-sectional, schematic view of an embodiment of the invention in the form of an insulating tile. Radiant heat emanating from a source (not shown) in the direction of arrows 10 encounters the insulating tile structure generally designated 11. The structure comprises a substantially rigid refractory, front or inner face plate 12 having surface 14 proximate the radiant heat source, rear or outer face plate 60 having an interior surface 62 and exterior surface 64, and sidewalls 66 which connect plates 12 and 60 to define an enclosure or shell with a hollow interior. Within the shell is a plurality (here 10) of parallel baffles 16, 20, 24, 28, 32, 36, 40, 44, 48 and 52 having surfaces (e.g. 18, 22 and 26) facing the source of radiant heat, and a reflector 56 having a reflective surface 58.

The number of baffles employed is determined by the amount one desires to reduce the radiant heat flux and by the temperature of the radiant heat source. The number employed is also influenced by whether the inner surfaces of the baffles have appreciable reflectivities, how reflective the surfaces are, and whether one or more highly reflective surfaces are used. The emissivity of surface 14 and the surfaces of the baffles (probably regardless of the material from which they are made) will rapidly approach 1.0 in use as they will be exposed to very high tempertures. If it were possible to fabricate the baffles and plate 12 (or to coat their surfaces) with a material having both a high reflectivity and a resistance to in-service thermal damage, then that material would be preferable. However, it is believed that no currently available material having a reasonable cost is suitable for this purpose. Accordingly, if a reflective surface is to be used, it should be shielded from the heat source by a sufficient number of refractory baffles such that the temperature to which it is exposed is well below the temperature at which it oxidizes, melts, or otherwise is damaged thermally.

The shell defined by plates 12, 60, and sidewalls 66 may be fabricated, for example, from any conventional refractory ceramic material. In the tile embodiment of the invention, it is preferred that some element parallel with the baffles be rigid enough to impart load bearing capability to the tile so that a plurality of tiles can be laid as bricks to define a liner for a furnace or the like. While it is preferable for plate 12 to be substantially rigid, it need not be load bearing. The baffles are fabricated from refractory sheet material, either rigid or flexible, and preferably define spaces which have air passage communicating with adjacent spaces. The baffles may be constructed, for example, of ceramic fiber cloths such as those sold under the tradenames NEXTEL (3M Company) or REFRASIL (Armco). The surfaces of the baffles may have any emissivity value whatever. The lower the value, the better. However, as noted previously, thermal effects will rapidly degrade the reflectivity of any practical material at the high temperatures of use. From necessity then the emissivity of the baffles will be greater than about 0.5.

Outer plate 60 in use will be at a much lower temperature than plate 12 and the baffles. Accordingly, appreciable reflectivity can be maintained, for example, on inner surface 62 and surface 58 of reflector 56. The emissivity of surfaces 62 and 58 should be less than 0.3, more preferably less than 0.1. Metal films are an example of materials that can readily achieve these reflective properties. These will not be degraded provided there are a sufficient number of baffles to protect against thermal damage of the reflective material one selects.

In a preferred embodiment, outer plate 60 has significant load bearing capacity and sidewalls 66 are thin so as to minimize heat transfer by conduction. Preferably, sidewalls 66 are constructed of a ceramic material having considerable thermal resistance. The baffles should be as thin as possible so that there is no appreciable heat conduction across the baffles. The tile can have air between the baffles or it may be evacuated; if the structure is not evacuated, the spacing between the baffles should be such that convective heat transfer is substantially eliminated as discussed above. The baffles may be spaced less than 0.15 or less than 0.05 inches apart. The baffles may be maintained in position by spacers such as thin rods or wire, or the baffles may be fabricated from corregarted material with the axes of corrugation disposed 90° apart in adjacent baffles.

Surface 64 of plate 60 should preferably have an emissivity greater than 0.8 and more preferably as close to 1.0 as possible. This is because the greater the emissivity of surface 64, the lower the temperature at which heat is dissipated from plate 60 to the environment. This protects the reflective coating on surface 62 from thermal degradation.

Sidewalls 66 may comprise flexible connecting means such as hinges to prevent damage due to thermal expansion of the structure or may be constructed of a material having substantially zero thermal expansion such as lithium-alumina-silica glass, available commercially under the trademark CERVIT.

Figure 3:
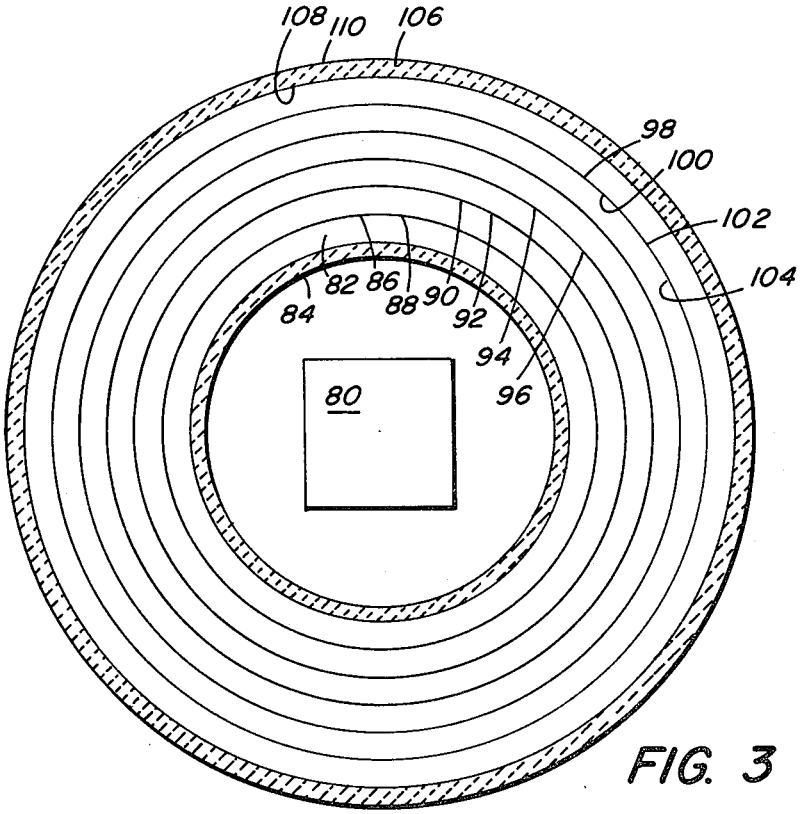
FIG. 3 illustrates a cross-sectional view of a furnace constructed in accordance with the invention.

FIG. 3 illustrates another embodiment of the invention, a furnace muffle, wherein a radiant heat source 80 is surrounded by a cylindrical muffle comprising an inner shell 82 having an inner surface 84 surrounded by baffles 86, 90, 94, 98 and 102 having surfaces 88, 92, 96, 100 and 104, respectively, directed towards radiant heat source 80. The baffles are constructed of refractory material utilizing the principles set forth above. The baffles are surrounded by outer shell 106 having a reflective inner surface 108 directed toward radiant heat source 80 and a non-reflective outer surface 110. The mode of operation of the insulating structure of FIG. 3 is fundamentally the same as the insulating tile illustrated in FIG. 2. In fact, the insulating structure of FIG. 3 may be constructed from a plurality of planar or arcuate tiles of the type generally described above.

The invention may be embodied in other specific forms without departing from the spirit and scope thereof. Accordingly, other embodiments within the following claims.

What is claimed is:

1. An insulating structure of low thermal conductivity for minimizing heat loss from a radiant heat source having a temperature above about 1000° F., said structure comprising:

a shell of refractory material comprising a front face for placement proximate the radiant heat source and a rear face substantially parallel to said front face, said front and rear faces being joined by walls which together with said faces define a hollow interior, and a plurality of refractory baffles having an emissivity greater than 0.5 disposed within said hollow interior substantially parallel to said front face and defining plural spaces therebetween.

2. The structure of claim 1 wherein said structure defines a furnace muffle.

3. The structure of claim 1 wherein at least one of said front and rear faces comprises a rigid, load-bearing member and said structure defines a refractory tile.

4. The structure of claim 1 comprising at least 10 baffles.

5. The structure of claim 1 wherein said hollow interior contains a gas, and the distance between adjacent baffles is selected to minimize convective heat transfer between adjacent baffles at said structure's temperature of use.

6. The structure of claim 5 wherein the distance between adjacent baffles is less than about 0.15 inch.

7. The structure of claim 5 wherein the distance between adjacent baffles is less than about 0.05 inch.

8. The structure of claim 1 wherein said spaces contain a gas at a subatmospheric pressure.

9. The structure of claim 1 further comprising a reflective surface facing and disposed substantially parallel to said front face, said reflective surface having an emissivity less than 0.5 and being separated from said front face by a plurality of said baffles.

10. The structure of claim 9 wherein said reflective surface has an emissivity less than about 0.2.

11. The structure of claim 1 or 9 wherein said baffles have an emissivity greater than 0.8.

12. The structure of claim 1 wherein said walls comprise refractory members joined by flexible connecting means.

13. The structure of claim 1 wherein said walls comprise a material having a substantially zero coefficient of thermal expansion between room temperature and its temperature of use.

14. A furnace comprising:

a radiant heat source which in operation is at a temperature in excess of 1000° F., and insulation for confining heat emitted from said heat source, said insulation comprising:

a shell comprising a front face of refractory material proximate said heat source and a rear face substantially parallel to said front face, said front and rear faces defining a hollow interior, and a plurality of refractory baffles having an emissivity greater than 0.5 disposed within said hollow interior substantially parallel to said front face and defining plural spaces therebetween.

15. The furnace of claim 14 wherein said insulation comprises a furnace muffle.

16. The furnace of claim 14 wherein at least one of said front and rear faces comprises a rigid, load-bearing plate and said shell defines a refractory tile.

17. The furnace of claim 14 comprising at least 10 baffles.

18. The furnace of claim 14 wherein said hollow interior contains a gas, and the distance between adjacent baffles is selected to minimize convective heat transfer between adjacent baffles at the temperature of operation of said heat source.

19. The furnace of claim 18 wherein the distance between adjacent baffles is less than about 0.15 inch.

20. The furnace of claim 18 wherein the distance between adjacent baffles is less than about 0.05 inch.

21. The furnace of claim 14 wherein said spaces contain a gas at a subatmospheric pressure.

22. The furnace of claim 14 further comprising a reflective surface facing and disposed substantially parallel to said front face, said reflective surface having an emissivity less than 0.5 and being separated from said front face by a plurality of said baffles.

23. The furnace of claim 22 wherein said surface has an emissivity less than about 0.2.

24. The furnace of claims 14 or 22 wherein said baffles have an emissivity greater than 0.8.

25. The furnace of claim 14 wherein said insulation comprises a material having a substantially zero coefficient of thermal expansion between room temperature and the temperature of operation of said heat source.

26. An insulating tile for use in shielding high temperature radiant heat sources comprising:

a face of refractory material for placement proximate the radiant heat source;

a rigid member for providing weight bearing capability to said tile;

a plurality of refractory, parallel, spaced-apart baffles disposed outwardly from said face, defining spaces therebetween; and at least one reflective surface disposed outwardly from, parallel to, and facing said baffles, said reflective surface having an emissivity less than about 0.3, the number of said baffles being sufficient to reduce the heat absorbed by said reflective surface to a level sufficient to avoid substantial increases in the emissivity of said reflective surface at the temperature of use of said tile.

27. The tile of claim 26 wherein said reflective surface has an emissivity less than about 0.1.

28. The tile of claim 26 comprising a plurality of said reflective surfaces.

29. The tile of claim 26 wherein said reflective surface is in thermal communication with means for dissipating heat.

30. The tile of claim 29 wherein said means for dissipating heat comprises a surface having an emissivity greater than 0.8.

31. The tile of claim 26 wherein said spaces contain a gas at a subatmospheric pressure.

32. The tile of claim 26 wherein said spaces contain a gas, and the ditance between adjacent baffles is selected to minimize convective heat transfer between adjacent baffles at said tile's temperature of use.

33. The tile of claim 32 wherein the distance between adjacent baffles is less than 0.15 inch.

34. The tile of claim 31 wherein the distance between adjacent baffles is less than 0.05 inch.

35. The tile of claim 26 wherein said baffles have an emissivity greater than 0.5.

* * * * *